US005966831A

United States Patent [19]

Anderson

[11] Patent Number: 5,966,831

[45] Date of Patent: Oct. 19, 1999

[54] FABRIC CONDITIONING DEVICE OF USE WITH A LAUNDRY DRYER

[75] Inventor: Michael R. Anderson, Boca Raton, Fla.

[73] Assignee: Vision International Production, Inc., Boca Ratton, Fla.

[21] Appl. No.: 09/038,619

[22] Filed: Mar. 11, 1998

Related U.S. Application Data

[60] Provisional application No. 60/040,470, Mar. 11, 1997.

[51] Int. Cl.[6] ..... F26B 19/00

[52] U.S. Cl. ..... 34/60

[58] Field of Search ..... 34/318, 321, 331, 34/389, 443, 60, 61, 63, 68, 90; 510/517, 519, 520

[56] References Cited

U.S. PATENT DOCUMENTS

| | | | |
|---|---|---|---|
| 3,870,145 | 3/1975 | Mizuno | 34/60 X |
| 4,167,594 | 9/1979 | Schwadtke et al. | 34/60 X |
| 4,567,675 | 2/1986 | Rennie | 34/60 |
| 5,040,311 | 8/1991 | Roy | 34/60 |
| 5,675,911 | 10/1997 | Moser | 34/389 |
| 5,804,219 | 9/1998 | Trinh et al. | 8/137 X |

*Primary Examiner*—Henry Bennett
*Assistant Examiner*—Steve Gravini
*Attorney, Agent, or Firm*—Malin, Haley, DiMaggio & Crosby, PA

[57] ABSTRACT

A device and method for use with an automatic laundry dryer for conditioning laundry articles during the drying cycle. The device comprises a carrier impregnated with microencapsulated fluid, for use with an automatic laundry dryer for dispensing said fluid during the drying cycle thereby conditioning laundry articles. In the preferred embodiment, a polyurethane foam carrier is impregnated with a microencapsulated active agent fluid for rendering the laundry articles substantially static-free and/or for dispensing fragrance to provide the articles with a desirable scent.

13 Claims, 1 Drawing Sheet

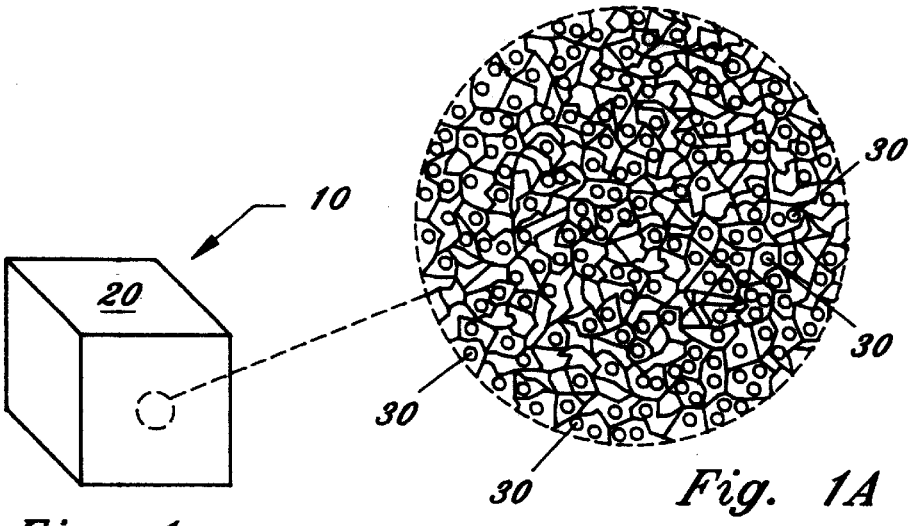
Fig. 1
Fig. 1A
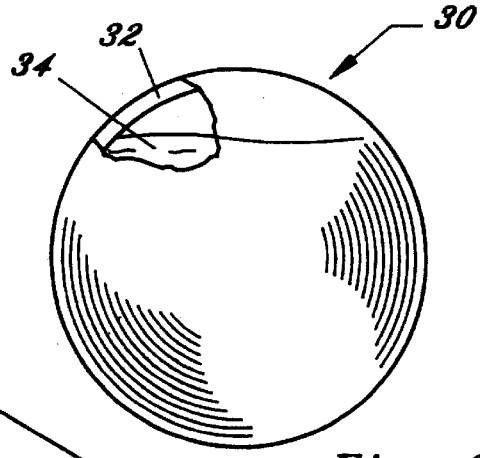
Fig. 2
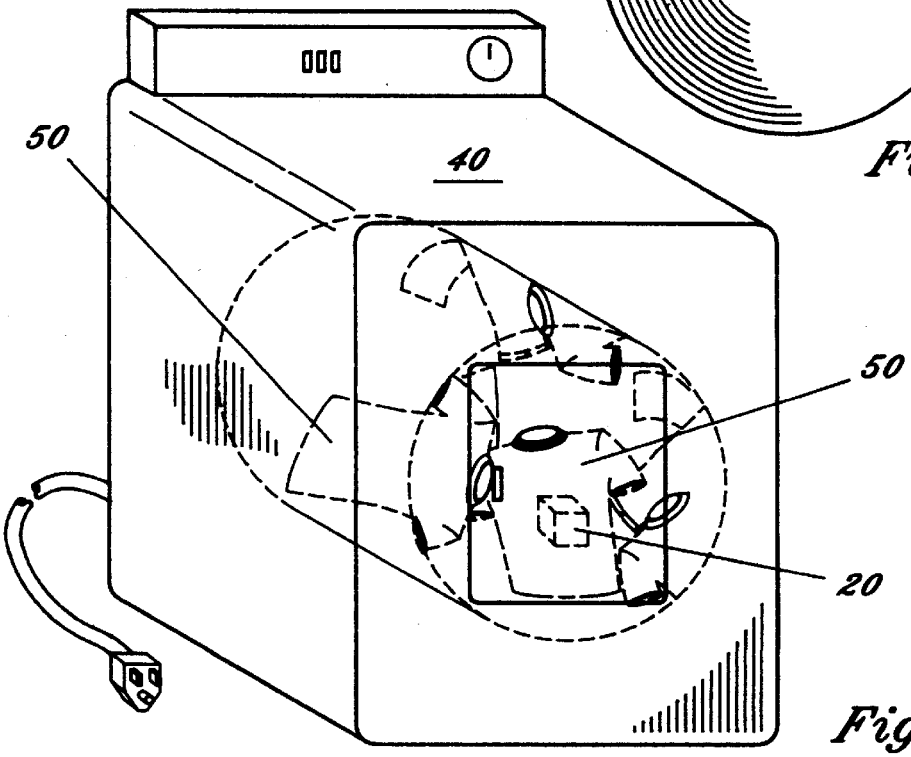
Fig. 3

FABRIC CONDITIONING DEVICE OF USE WITH A LAUNDRY DRYER

This application claims the benefit of Provisional Application Serial No. 60/040,470, filed Mar. 11, 1997.

BACKGROUND OF THE INVENTION

1. Field of the Invention

The present invention relates to laundering devices, and more particularly to a device, and method for use thereof for conditioning laundry articles in an automatic laundry dryer during a drying cycle.

2. Description of the Background Art

Automatic laundry dryers are well known in the art for drying recently washed moisture laden fabrics such as clothing and the like (hereinafter "laundry articles" or "articles"). Typically, automatic laundry dryers remove moisture from moisture laden articles by causing the articles to tumble in a heated air stream whereby moisture is absorbed by the heated air stream and subsequently vented to the atmosphere. Automatic laundry dryers are common appliances in homes throughout the world.

A common problem experienced when drying laundry according to this and other prior art drying methods is the build-up of static electrical charges on the laundry articles resulting in what has commonly been referred to as "static cling." Specifically, the tumbling of the laundry articles in a heated environment causes the articles to acquire positive static charges, which, if not dissipated, result in the undesirable situation where the articles cling to one another or other oppositely charged surfaces. Accordingly, it is desirable to eliminate static cling by neutralizing static charge build-up generated during the drying cycle.

An additional problem in the laundry drying art involves the application of fragrances directly to the laundry articles during the drying process thereby resulting in a desirable scent. It is known in the background art to use scented detergents, disposable dryer sheets and the like in an effort to obtain freshly scented laundered articles. Furthermore, many consumers prefer specialized scents (e.g. lemon).

In an attempt to satisfy these demands, the prior art reveals devices for use with a laundry dryer to eliminate static cling by neutralizing static charge build-up and for further conditioning laundry articles during the drying process. For example, it is known in the art to use a fabric conditioning device comprising a thin polyurethane foam substrate impregnated with a conditioning agent, which substrate is fabricated such that the agent is entrapped or entrained within the cellular structure of the foam and dispensed during a single cycle. An example of such a device is available from Beecham, Inc. and sold under the trademark Cling Free®, as a dryer-added fabric softener and anti-static device which is co-mingled with laundry articles to be rendered soft and/or substantially static-free in an automatic laundry dryer during the drying cycle.

A further example is U.S. Pat. No. 4,460,644, issued to Pavlich, which discloses a fabric conditioning device for use in an automatic laundry dryer, which device comprises a polyurethane foam substrate impregnated with, or coated with, an effective amount of a fabric conditioning agent, an anti-microbially effective amount of a halide ion-coating agent and an anti-discoloration effective amount of zinc sulfate, sorbitol or dextrose. However, since these prior art devices are only effective for one cycle they must be disposed of thus contributing to the accumulation of solid waste in landfills. Accordingly, there exists a need for a device, for use with a laundry dryer, for eliminating static build-up on laundry articles which is capable of repeated use.

Furthermore, these background art devices are limited to the application of "dry" conditioning agents during the drying cycle. Thus, there also exists a need for a device for use with a laundry dryer for dispensing controlled quantities of liquid conditioning agents during the drying cycle, since liquid conditioning agents may be more effective than "dry" conditioning agents. It is also preferable that such a device be capable of substantial repeated use without the need for disposal, refill, or recharge.

SUMMARY OF THE INVENTION

A device for use with an automatic laundry dryer during the drying cycle for rendering fabrics substantially static-free and/or for dispensing fragrance to provide the fabrics with a desirable scent.

In the preferred embodiment, the device comprises a three-dimensional body, such as a polyurethane foam carrier, impregnated by microencapsulation with at least one liquid substance preferably including an ion-containing anti-static agent (hereinafter "active agent"). The use of microencapsulation technology allows for the use of a liquid active ion-containing agent which has proven highly effective in reducing static cling. Specifically, the active agent is packaged in a plurality of microcapsules with preferred average diameters of less than 100 microns. The microcapsules are then mixed with the chemicals which form open-cell polyurethane foam, whereby impregnation results in entrapping or entraining the microcapsules within the cellular structure of the foam. The active agent is released in a controlled manner over multiple drying cycles as the foam carrier and microcapsules are exposed to impact and heat.

In an alternate embodiment, microcapsules containing an alternate active agent including a fragrance agent are used to provide the fabrics with a specific scent. Furthermore, a mixture of microcapsules containing a fragrance agent and microcapsules containing an ion-containing anti-static agent may be used in a single foam carrier to produce the combined result of rendering fabrics static free and dispensing fragrance to provide the fabrics with a particular scent.

Accordingly, it is an object of the present invention to provide a fabric conditioning article for use with an automatic laundry dryer, which article is impregnated with microcapsules containing an active fabric conditioning substance.

Yet another object of the present invention is to provide a foam carrier impregnated with microcapsules containing an active fabric conditioning substance.

Still another object of the present invention is to provide a foam carrier impregnated with microcapsules containing an anti-static agent for use with fabrics in an automatic laundry dryer to eliminate static cling.

A further object of the present invention is to provide a foam carrier impregnated with microcapsules containing a fragrance agent for use with fabrics in an automatic laundry dryer to produce a desired scent.

In accordance with these and other objects which will become apparent hereinafter, the instant invention will now be described with particular reference to the accompanying drawings.

BRIEF DESCRIPTION OF THE DRAWINGS

FIG. 1 is a front perspective view of the preferred embodiment of the present invention;

FIG. 1A is a magnified detail of the area of the invention indicated by the circle in FIG. 1;

FIG. 2 a front perspective detail view of a microcapsule for use with the present invention;

FIG. 3 is a front perspective view of the present invention in use with an automatic laundry dryer.

DESCRIPTION OF THE PREFERRED EMBODIMENTS

FIGS. 1 and 1A depicts a preferred embodiment of the device of the present invention, generally referenced as 10. The invention comprises a device for use with an automatic laundry dryer during the drying cycle for rendering fabrics substantially static-free and/or for dispensing fragrance to provide the fabrics with a desirable scent. The device 10 comprises a three-dimensional polyurethane foam carrier 20. In the preferred embodiment, foam carrier 20 is cube shaped, however, any three-dimensional shape is within the scope of the invention. Suitable dimensions for carrier 20 are approximately two inches by two inches by two inches, although other dimensions and three-dimensional shapes are within the scope of the invention.

As best seen in FIG. 1A, foam carrier 20 comprises an open-cell structure and is impregnated with a plurality of microcapsules 30. As depicted in FIG. 2, each microcapsule 30 includes a generally spherical capsule wall 32 and contains a quantity of fluid 34. In the preferred embodiment, each microcapsule 30 is filled with an ion-containing anti-static agent (hereinafter "active agent"). The use of microencapsulation technology allows for the use of a liquid active ion-containing agent which has proven highly effective in reducing static cling. Specifically, the active agent is packaged in a plurality of microcapsules with preferred average diameters of less than 100 microns, however, any suitable diameter is within the scope of the invention. Such microencapsulation technology is available from Hallcrest, Inc. of Glenview, Ill., which company produces microcapsules ranging in diameter from 5 to 2000 microns. Accordingly, microencapsulation provides a vehicle for incorporating various liquid agents within the cell structure of carrier 20 by mixing microcapsules with the chemicals used to form the three dimensional open-cell polyurethane foam structure. Therefore, impregnation of the foam is achieved when microcapsules are in entrapped or entrained within the cellular structure of the foam. An effective quantity of microcapsules are impregnated within the polyurethane foam structure to yield an effective release rate of liquid agent. The active agent is released in a controlled manner over multiple drying cycles as the foam carrier and microcapsules are exposed to impact and heat.

In the preferred embodiment, directed to eliminating static cling, microcapsules 30 are filled with ion-containing fluid for producing an anti-static effect when released during the drying cycle. An example of ion-containing substances includes a suitable combination selected from among the following substances: (1) Ammonium Lauryl Sulfate; (2) Sodium Lauryl Sulfate; (3) Tea Lauryl Sulfate; (4) Dea Lauryl Sulfate; (5) Amonium Laureth Sulfate; (6) Sodium Laureth Sulfate; (7) Sodium Trideceth Sulfate; (8) Sodium C 14–16 Olefin Sulfonate; (9) TeaDodecylbenzenesulfonate; (10) Sodium Methyl 2-Sulfolaurate and Sodium Ethyl 2-Sulfolureate; (11) Sodium Lauroyl Sarcosinate; (12) Sodium Lauryl Sulfoacetate; (13) Disodium Oleamido PEG-2 Sulfosuccinate; (14) Disodium Laureth Sulfosuccinate; (15) Disodium Laureth Sulfosuccinate and Sodium Lauryl Sulfoacetate; (16) Sodium C 14–16 Olefin Sulfonate/Sodium Laureth Sulfate/Lauramide Dea; (17) Ammonium Lauryl Sulfate/Ammonium Laureth Sulfate/Cocamidopropyl Dimethylamine; (18) Ammonium Laureth Sulfate/Cocamide MEA/DEA Lauryl Sulfate/DEA Lauraminopropionate/Sodium Laraminopropionate; (19) Sodium Lauryl Sulfate/Lauramide DEA; (20) Trideceth-7-Carboxylic Acid; (21) Lauramine Oxide; (22) Myristamine Oxide; (23) Cetamine Oxide; (24) Oleamine Oxide; (25) Stearamine Oxide; (26) Cocamidopropylamine Oxide; (27) Cocamidopropyl Betaine; (28) Amine Alkylbenzene Sulfonate; (29) Sodium 1-Octane Sulfonate; (30) Ethoxylated Nonyl Phenol Phosphate; (31) Sodium Alpha Sulfo Methyl Laureate; and (32) Cocamidopropyl Hydrosltaine. The preferred embodiment, however, contemplates any suitable microencapsulated ion-containing fluid.

In an alternate embodiment, microcapsules 30 contain an alternate active agent including a fragrance agent and are used to provide the fabrics with a specific desirable scent. Furthermore, it is contemplated that a mixture of microcapsules containing a fragrance agent and microcapsules containing an ion-containing anti-static agent may be used in a single foam carrier to produce the combined result of rendering fabrics static free and dispensing fragrance to provide the fabrics with a particular scent.

As best depicted in FIG. 3, the device of the present invention is used with an automatic laundry dryer 40, and specifically is placed in the drying chamber with articles of clothing, generally referenced as 50. During the drying cycle, the foam carrier 20 is caused to tumble and co-mingled with clothing 50 within the dryer. Accordingly, the device 10 is exposed to heat and impact during the drying cycle whereby at least a portion of microcapsules 30 are caused to rupture thereby dispensing the fluid contained therein.

It is preferable that only a portion of the microcapsules 30 rupture during a drying cycle. Therefore, it may be desirable to impregnate foam carrier 20 with microcapsules of various diameters or wall thicknesses, since capsule wall thickness and diameter generally dictate the ability of the capsule to withstand agitation and sheer. Thus, microcapsules having large diameters and/or thin walls are likely to rupture during the early portion of the device's effective operating life, while microcapsules having small diameters and/or thick walls are likely to rupture during the latter portion of the device's operating life after having been exposed to repeated cycles and thus weakened by fatigue and sheer. Furthermore, since larger capsules contain a larger volume of active agent than do smaller capsules, it may be desirable to impregnate carrier 20 with both large and small, or conversely thick wall and thin wall, capsules in a suitable ratio to insure relatively even dispensing of the active agent over the effective operating life of the device. In any event, the present device is capable of repeated use without loss of effectiveness for many washing cycles.

In the preferred embodiment the dispensed fluid is an ion-containing anti-static agent which effectively neutralizes the naturally occurring build-up of static charges. In the alternate embodiment the dispensed fluid contains a fragrance agent which produces a desired scent associated with the washed and dried laundry articles. In yet another alternate embodiment carrier 20 may be impregnated with a plurality of microcapsules filled with an ion-containing anti-static agent and a plurality of microcapsules filled with a fragrance agent. Furthermore, it is within the scope of the invention that carrier 20 may be impregnated with microcapsules containing any desirable fabric conditioning substance.

As is now apparent, the present invention includes a method of conditioning laundry articles in an automatic laundry dryer by dispensing of microencapsulated fluid. The method includes the steps of: (1) selecting an active agent for conditioning laundry articles; (2) packaging the selected active agent in a plurality of microcapsules; (3) impregnating a suitable carrier with microcapsules containing the selected active agent; (4) inserting the foam carrier in an automatic laundry dryer with laundry articles to be conditioned; (5) operating the laundry dryer in a drying cycle whereby heat and agitation cause at least a portion of the microcapsules to rupture thereby dispensing the active agent and exposing the active agent to the laundry articles.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A device for conditioning laundry fabrics in an automatic laundry dryer during the drying cycle, said device comprising:

a carrier body for insertion in the automatic laundry dryer with laundry;

said carrier body impregnated with a plurality of microcapsules, each of said microcapsules containing a fabric conditioning agent within a rupturable capsule wall;

whereby said carrier body is subjected to heat and impact during operation of the laundry dryer causing at least a portion of said capsule walls to rupture thereby dispensing said fabric conditioning agent.

2. A device for conditioning laundry fabrics in an automatic laundry dryer during the drying cycle according to claim 1, wherein said fabric conditioning agent is a fluid.

3. A device for conditioning laundry fabrics in an automatic laundry dryer during the drying cycle according to claim 2, wherein said fluid is an anti-static agent for reducing static cling.

4. A device for conditioning laundry fabrics in an automatic laundry dryer during the drying cycle according to claim 2, wherein said fluid is a fragrance agent.

5. A device for conditioning laundry fabrics in an automatic laundry dryer during the drying cycle according to claim 1, wherein said carrier body is formed from polyurethane foam.

6. A device for conditioning laundry fabrics in an automatic laundry dryer during the drying cycle according to claim 1, wherein said plurality of microcapsules have various wall thicknesses.

7. A device for conditioning laundry fabrics in an automatic laundry dryer during the drying cycle according to claim 1, wherein said plurality of microcapsules have various diameters.

8. A device for conditioning laundry fabrics in an automatic laundry dryer during the drying cycle, said device comprising:

an open-cell polyurethane foam carrier body for insertion in the automatic laundry dryer;

said polyurethane foam impregnated with a plurality of generally spherical microcapsules, each of said microcapsules containing a fabric conditioning agent within a rupturable capsule wall, wherein a first portion of said plurality of microcapsules have a first diameter, and a second portion of said plurality of microcapsules have a second diameter, said second diameter being less than said first diameter;

whereby said carrier body is subjected to heat and impact during operation of the laundry dryer causing at least a portion of said capsule walls to rupture thereby dispensing said fabric conditioning agent, and whereby said first portion of said plurality of microcapsules are likely to rupture within a first number of drying cycles and said second portion of said plurality of microcapsules are likely to rupture during drying cycles after said first number of drying cycles such that the device is effective in conditioning fabrics in repeated use over many drying cycles.

9. A device for conditioning laundry fabrics in an automatic laundry dryer during the drying cycle, according to claim 8, wherein said foam carrier body is cube shaped.

10. A device for conditioning laundry fabrics in an automatic laundry dryer during the drying cycle, according to claim 8, wherein said foam carrier body is spherical.

11. A device for conditioning laundry fabrics in an automatic laundry dryer during the drying cycle, according to claim 8, wherein said fluid is an anti-static agent for reducing static cling.

12. A device for conditioning laundry fabrics in an automatic laundry dryer during the drying cycle, according to claim 8, wherein said fluid is a fragrance for providing laundry fabrics with a desirable scent.

13. A device for conditioning laundry fabrics in an automatic laundry dryer during the drying cycle, according to claim 8, wherein said microcapsules have a variety of diameters ranging between 5 and 2000 microns.

* * * * *